US005151560A

United States Patent [19]

Kreinberg et al.

[11] Patent Number: 5,151,560

[45] Date of Patent: Sep. 29, 1992

[54] GROUNDING CONNECTOR

[75] Inventors: Earl R. Kreinberg, Peoria; Marty E. Adcock, Scottsdale, both of Ariz.

[73] Assignee: AMP Incorporated, Harrisburg, Pa.

[21] Appl. No.: 754,884

[22] Filed: Sep. 4, 1991

Related U.S. Application Data

[63] Continuation-in-part of Ser. No. 624,858, Dec. 10, 1990.

[51] Int. Cl.[5] ..... H01R 11/00

[52] U.S. Cl. ..... 174/94 R; 174/78; 174/84 C; 439/879

[58] Field of Search ..... 174/94 R, 78, 84 C; 439/217, 790, 877, 879

[56] References Cited

U.S. PATENT DOCUMENTS

| | | | |
|---|---|---|---|
| 2,190,824 | 2/1938 | Cook | 174/94 R |
| 2,450,158 | 9/1944 | Pennell | 287/77 |
| 2,749,383 | 7/1952 | Pigman et al. | 174/84 C |
| 3,168,615 | 2/1965 | Owen et al. | 174/84 C |
| 3,320,354 | 5/1967 | Marley et al. | 174/84 C |
| 3,410,950 | 11/1968 | Freudenberg | 174/84 C |
| 3,514,528 | 5/1970 | Ray | 174/84 C |
| 3,553,347 | 1/1971 | Harding et al. | 174/84 C |
| 3,588,791 | 6/1971 | Polidori . | |
| 3,715,456 | 2/1973 | Faulkner | 174/84 C |
| 3,715,705 | 2/1973 | Kuo | 174/94 R |
| 3,838,387 | 9/1974 | Grillet | 174/94 R |
| 4,734,062 | 3/1988 | Goto | 439/783 |
| 4,875,876 | 10/1989 | O'Loughlin | 439/431 |
| 4,922,058 | 5/1990 | Rodrigues | 174/94 R |
| 5,004,869 | 4/1991 | Koblitz et al. | 174/84 C |

FOREIGN PATENT DOCUMENTS 731999 2/1943 Fed. Rep. of Germany .

*Primary Examiner*—Morris H. Nimmo
*Attorney, Agent, or Firm*—Anton P. Ness

[57] ABSTRACT

A grounding connector for interconnecting a pair of uninsulated conductors such as wires includes an outer body member having diverging tabs extending from upper extents of vertical walls of a U-shaped channel, the tabs being crimpable toward each other when applied to the wires. An inner body member includes a base section crossing the top of the U-shaped channel and diverging inner tabs extending along the inside surfaces of the outer body member to assured stops at the ends of the outer tabs. When the outer tabs are crimped to a vertical orientation, the inner tabs are also crimped to a vertical orientation and urge the base section against the wires in the U-shaped channel. The inner body member presses the wires against upper and lower surfaces of a conductive insert so that arrays of penetrating spikes along the insert surfaces break through corrosion of the wires and assuredly electrically interconnect the wires. The insert is shaped to accommodate interconnecting a pair of flat wires, a pair of round wires, or one of each, or a wire and a rod or pipe.

29 Claims, 12 Drawing Sheets

GROUNDING CONNECTOR

CROSS-REFERENCE TO RELATED APPLICATION

This is a continuation-in-part of U.S. patent application Ser. No. 07/624,858 filed Dec. 10, 1990.

FIELD OF THE INVENTION

This relates to the field of electrical connectors and more particularly to grounding connectors.

BACKGROUND OF THE INVENTION

In certain electrical wiring arrangements such as in utilities or in telecommunications, it is necessary to interconnect a pair of uninsulated conductors to establish a system ground. Where the conductors are uninsulated for long periods of time prior to being interconnected, a substantial layer of corrosion forms on the conductor surfaces having a thickness of about 0.001 inches and in spots up to about 0.0035 inches. It is necessary for the connector selected to interconnect a pair of such corrosion-encrusted conductors, to establish an assured electrical connection with the conductive portion of the conductors beneath the corrosion layer, sufficient to establish a ground connection. It is also necessary for the connector to remain firmly secured to the conductors and assuredly electrically interconnecting them over long in-service use, while exposed to the environment.

It is desirable to be able to apply a connector directly to the corrosion-encrusted conductors rather than involve a procedure to remove the corrosion prior to application. It is further desirable for such a connector to be easily applied without special tools or involving an operator-sensitive procedure. It is also desirable for the connector to provide a visual indication of an assured electrical connection.

It is additionally desirable for such a connector to be applicable either round wires or flat wires, or one of each, or of a wire to a larger diameter rod or pipe.

SUMMARY OF THE INVENTION

The present invention is an assembly which includes a pair of cooperable body members together defining a conductor-receiving region between opposed clamping surfaces; when the body members are manipulated or squeezed into an applied configuration, the clamping surfaces are urged toward each other and against the conductors such as wires, and the wires are pressed against corrosion-penetrating means such as small spikes which break through the corrosion and dig deeply into uncorroded metal thereunder, and thereby establish a ground connection with the conductive metal therebeneath. Preferably an insert member is disposed in the conductor-receiving region between the clamping surfaces against which the wires are clamped and which includes arrays of penetration spikes extending toward the clamping surfaces. The assembly defines a pair of separate passageways through which the wires are inserted, after which the assembly is deformed such as by pliers to clamp the wires against the penetration spikes of the insert. The plurality of penetration spikes upon clamping penetrate the corrosion on the adjacent surfaces of both wires to reach the uncorroded conductive material therewithin, thereby electrically interconnecting the wires to each other sufficient to establish an assured grounding connection.

The outer body member includes a first base section, vertical walls coextending upwardly from the first base section to form a U-shaped channel into which the insert member is disposed, and an outer extension such as a tab extends upwardly and outwardly from each of the walls at a selected angle. The inner body member is disposed between the diverging outer tabs and includes a second base section adjacent the insert member and inner extensions such as tabs extending therefrom along inside surfaces of the outer tabs. The inside surfaces of the first and second base sections define opposed first and second clamping surfaces, which face respective first and second wire-proximate faces of the insert member and define the first and second wire-receiving passageways.

When wires have been disposed in the wire-receiving passageways, the diverging outer tabs are squeezed toward each other such as by pliers until rotated into a vertical orientation about the upper extents of the vertical walls of the U-shaped channel; the outer tabs cause the inner tabs to be likewise rotated into a vertical alignment about the integral joints with the second base section. The outer tabs include means such as bent-back free ends which cooperate with associated means of the inner tabs such as free ends thereof which are disposed within the bent-back free ends, cooperable during crimping of the outer tabs together to constrain the inner tabs to be translated toward the wires during crimping; the inner tabs urge the second base section toward the first base section and press the wires in the passageways against the plurality of penetration spikes arrayed along the wire-proximate faces of the insert member.

The insert member is adapted to provide passageways and penetration spikes for either round wires or flat wires of selected dimensions. The insert member preferably includes a planar body section and raised platforms extending upwardly and downwardly from the four corners of the planar body section. The raised platforms are spaced from each other a distance just larger than the diameter of the round wire for which the connector is fabricated to be used, while the height of the platforms is less than the round wire diameter; the region between the platforms is thus adapted for round wire so that the wire extends upwardly beyond the outer ends of the platforms to be engaged by the first or second base section. The insert member is also usable with flat wire having a width about as wide as the insert member so that the outer ends of the raised platforms engage the flat wire near both edges. The arrays of penetration spikes are disposed along the outer surface portions of the raised platforms to engage flat wire, and along the central region of the planar body section to engage round wire, of each wire-proximate face of the insert member.

Preferably the insert member includes four legs extending upwardly from lateral edges of the planar body section and along edges of the vertical walls of the outer body member defining the U-shaped channel. Free ends of the legs include outwardly extending latching sections above the upper extents of the vertical walls to latch along outer surfaces of the outer tabs after the tabs have been squeezed together and thereby rotated into vertical orientation, thus providing a visual indication of the completed electrical connection and a means to deter relaxation of the outer tabs. While the insert member is made of low resistance copper alloy, the outer and inner body members can be made of copper alloy or made of deformable stainless steel.

The outer and inner body members may be adapted to provide for appropriately locating the inner body member centered therewithin just prior to crimping, such as providing locating bosses extending from central portions of the free ends of the tabs of the inner body member which are received in apertures through the bends of the tabs of the outer body member and centered therealong. The free ends of the tabs of the outer body member may also be adapted to engage each other upon full crimping and lock together, mechanically assuring that the connector remains applied to the conductors after crimping.

In another embodiment of the grounding connector of the present invention, the outer and inner body members and the insert member are adapted to groundingly connect a round wire to a larger diameter ground rod (or pipe). The base section of the outer body member is essentially V-shaped with the apex of the V being round to receive the smaller diameter wire therealong, while the base section of the inner body member is convex upwardly with a radius approximately matching the diameter of the rod. The insert member may have a planar upper surface with at least two rows of corrosion-penetrating spikes to establish a connection with the rod upon crimping, while the lower surface can have opposing angled ridges depending from side edges thereof to correspond both with the sides of the V-shaped base section of the outer body member and to extend partially around the small diameter wire thereunder, with arrays of corrosion-penetrating spikes along the surface portion between the ridges. Also the tabs of the outer body member may include lances extending inwardly from central portions thereof to engage and support the inner body member for uniform bending during crimping; the tabs of the outer body member preferably include means for free ends thereof to lock together upon full crimping for an assured mechanical connection to the wire and rod.

It is an objective of the present invention to provide an electrical grounding connector easily applied to uninsulated conductors of certain dimensions to establish a grounding connection therebetween without requiring special tools or particular skill.

It is another objective for the connector to be especially adapted to be applied to corroded conductors and penetrate the corrosion upon simple application to establish an assured grounding connection therebetween.

It is yet another objective for the connector to be usable with either round wire or flat wire or both, or to a wire and a large diameter rod or pipe.

It is additionally an objective for such connector to be previously assembled into a self-secured connector assembly which can if desired be easily disassembled on site to be easily reassembled around intermediate portions of continuous conductors upon application.

It is still another objective for the connector to provide a mechanical, visual and audible indication of assured connection.

It is also an objective of the connector of the present invention to be fabricated at low cost.

An embodiment of the grounding connector will now be disclosed by way of example with reference to the accompanying drawings.

DETAILED DESCRIPTION OF THE PREFERRED EMBODIMENTS

Figure 1:
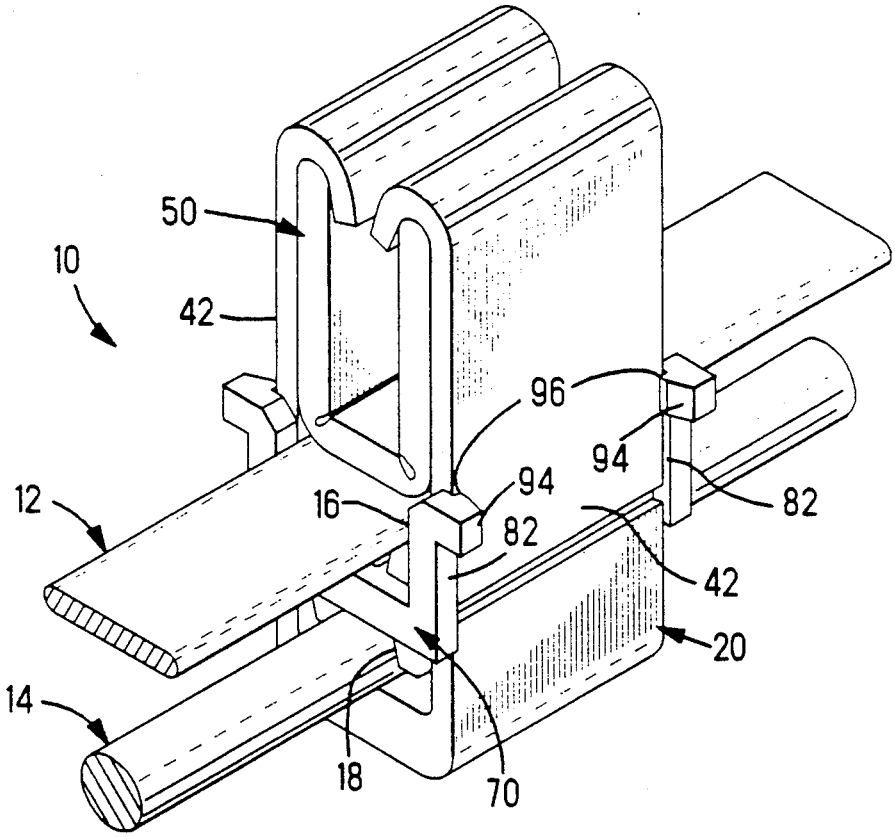
FIG. 1 is an illustration of the grounding connector of the present invention applied to round and flat wires.
Figure 2:
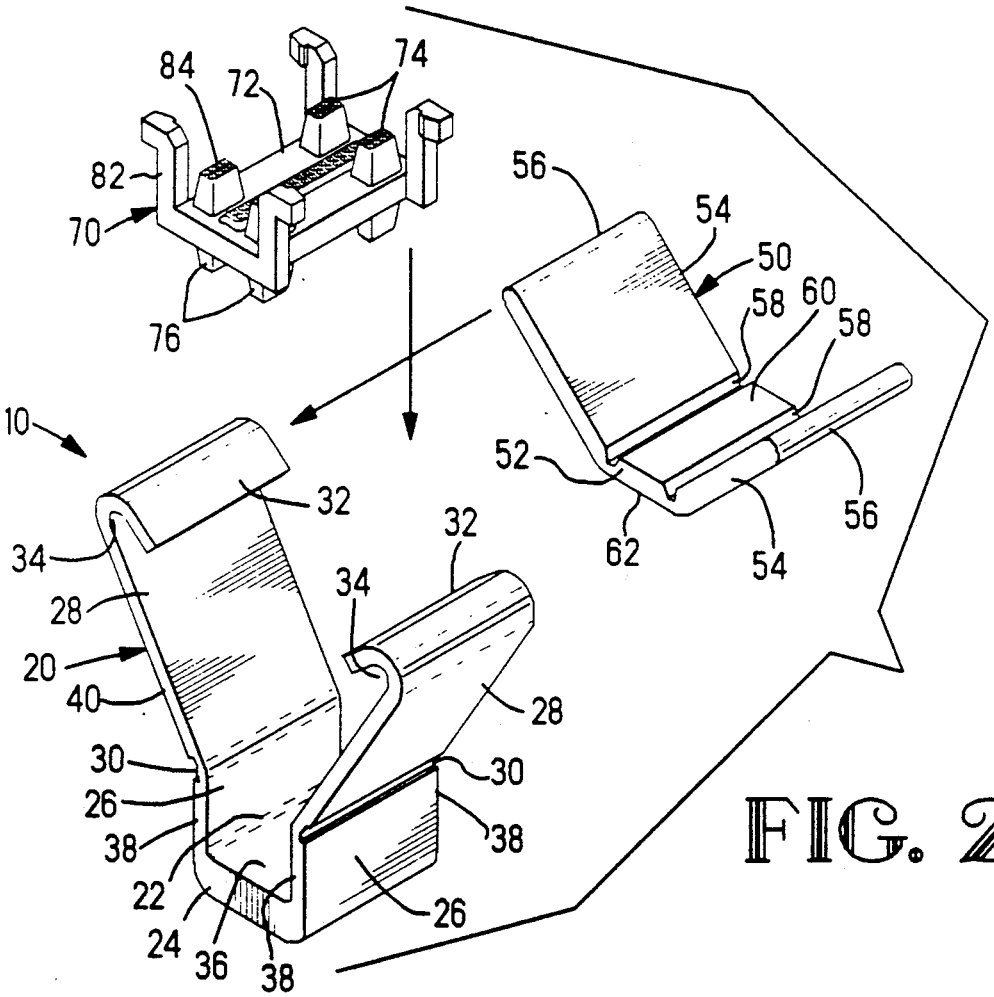
FIG. 2 is an exploded perspective view of the connector of FIG. 1 showing the outer and inner body members and the insert member thereof.
Figure 3:
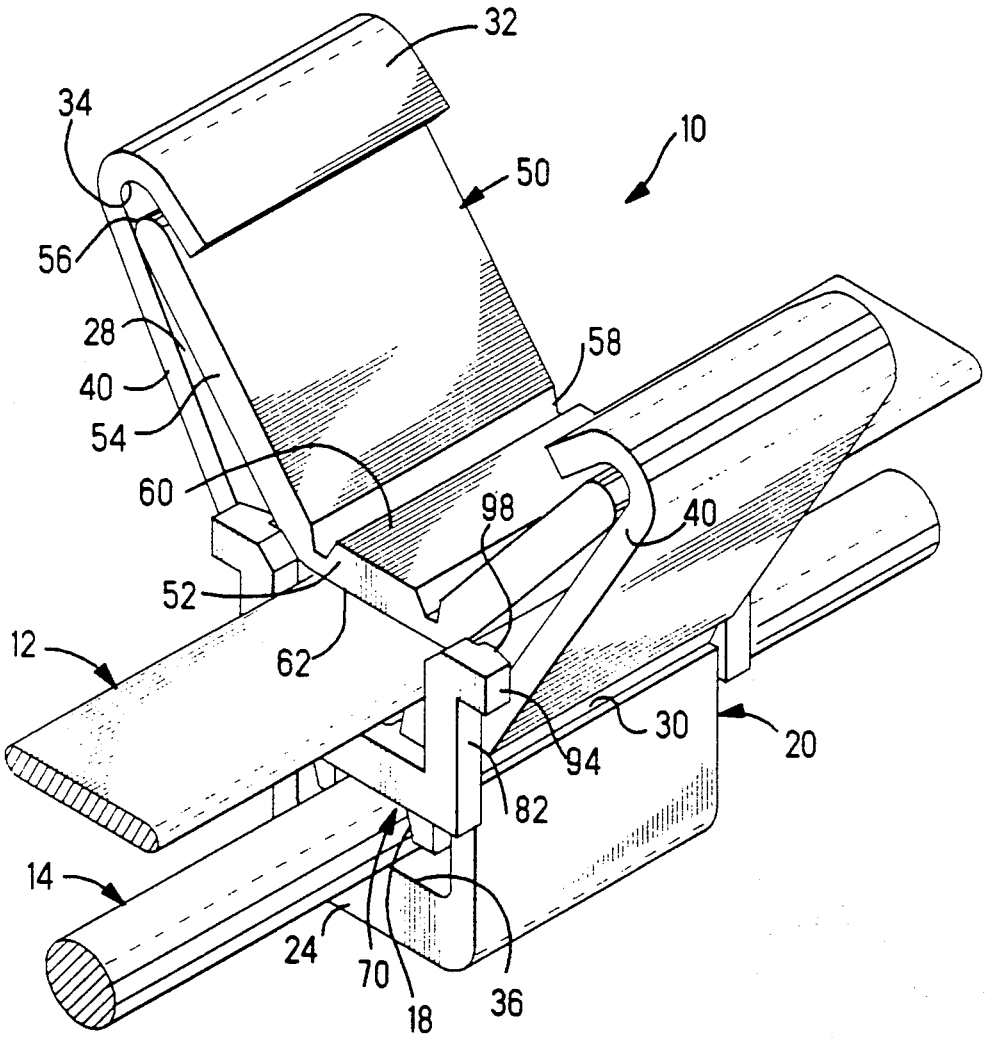
FIG. 3 is a perspective view of the connector of FIGS. 1 and 2 prior to application to the wires.

Grounding connector assembly 10 is shown in FIG. 1 after being applied to a pair of uninsulated conductors such as wires 12,14 to establish a grounding connection therebetween. As shown in FIG. 2, outer body member 20, inner body member 50 and insert member 70 comprising connector assembly 10 can be previously assembled prior to application, so that ends of wires 12,14 are insertable into respective wire-receiving passageways 16,18 of assembly 10. If assembly 10 is to be applied to intermediate portions of both wires 12,14 where both wires are continuous, outer and inner body members 20,50 and insert member 70 can be assembled around the wires, by placing wire 14 in U-shaped channel 22, then placing insert member 70 thereover, then placing wire 12 thereabove, and finally inserting inner body member 50 into outer body member 20 above wire 12. Where one of wires 12,14 is continuous, inner body member 50 is easily removed from assembly 10, the continuous wire is lowered into position atop insert member 70, inner body member 50 is slid back into place atop the wire, and the end of the other wire is inserted into passageway 18. FIG. 3 illustrates the connector assembly 10 after being disposed around wires 12,14 but prior to being crimpingly deformed into its final wire-clamping configuration as in FIGS. 1 and 6.

Figure 5:
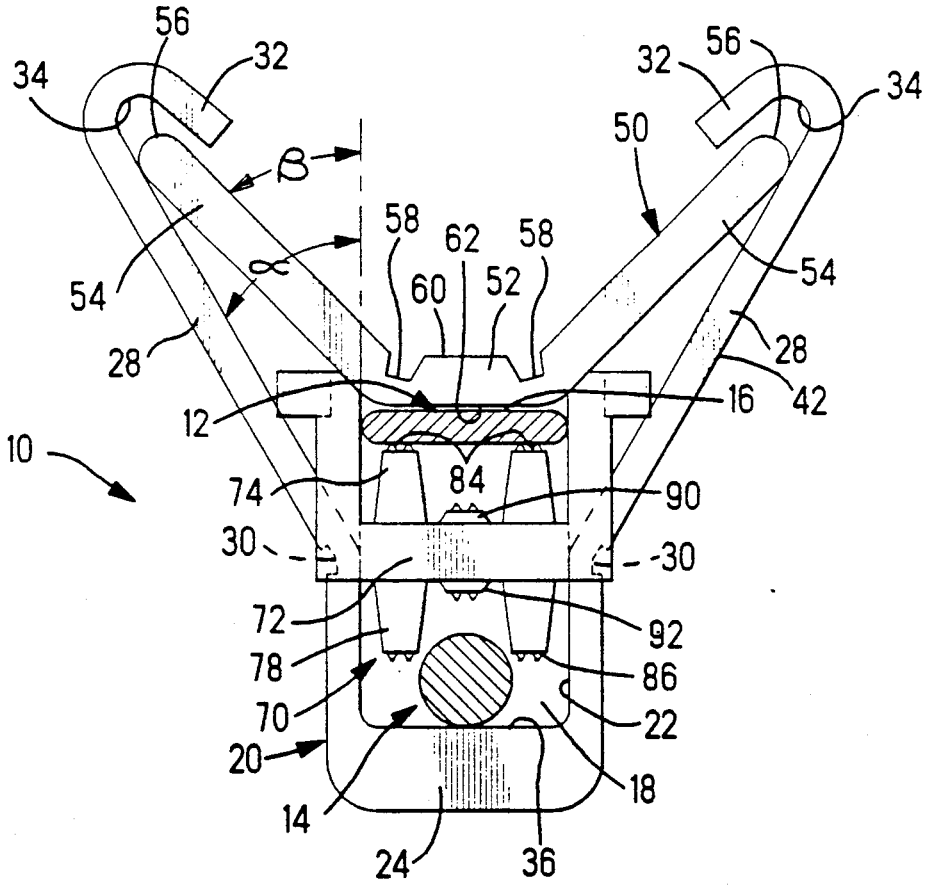
FIG. 5 is an elevation view of the connector of FIG. 3 prior to application to a flat wire and a round wire.
Figure 7:
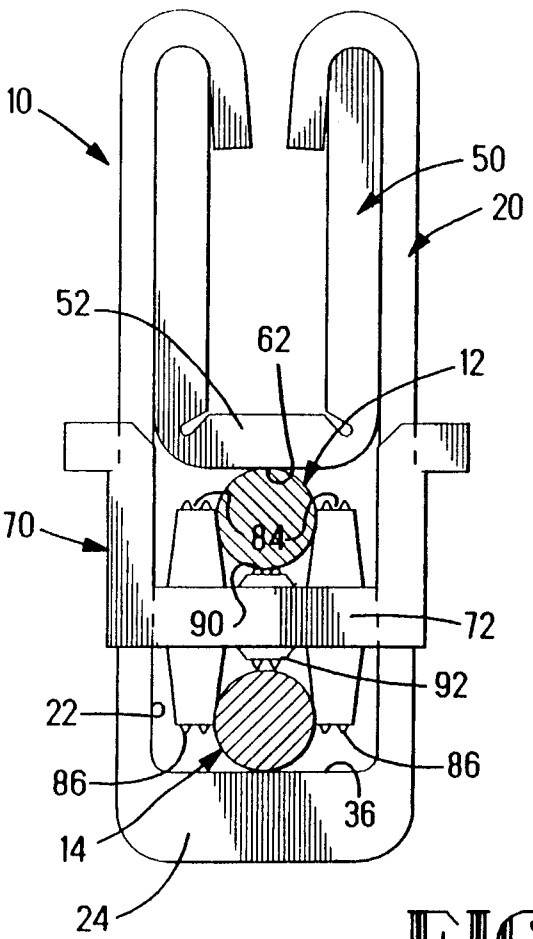
FIGS. 6 to 8 are elevation views illustrating the connector after application to flat and round wires, two round wires, and two flat wires respectively.

Outer body member 20 includes a first base section 24, vertical wall sections 26 extending upwardly therefrom to define U-shaped channel 22, and outer projections such as tabs 28 extending upwardly from bends 30 defining upper extents of wall sections 26 and diverging outwardly therefrom at selected angles $\alpha$ (FIG. 5). Preferably notches are formed at bends 30 into outer surfaces of outer body member 20 to enhance controlled bending thereat during crimping. Free ends 32 are bent back to form slots 34.

Inner body member 50 includes a second base section 52 and inner projections such as tabs 54 extending upwardly and outwardly from lateral edges thereof at selected angles $\beta$ (FIG. 5) which are greater than angles $\alpha$ of outer tabs 28. Free ends 56 of inner tabs 54 are of a length to be disposed within slots 34 of free ends 32 of outer tabs 28 when inner body member 50 is assembled into outer body member 20 above insert member 70. Second base section 52 is narrower than first base section 24 and is dimensioned to be no wider than U-shaped channel 22 defined between vertical wall sections 26 of outer body member 20. Grooves 58 are formed into the upwardly facing surface 60 of inner body member 50 to facilitate controlled bending of inner tabs 54 at selected positions across second base section 52.

Downwardly facing surface 62 of second base section 52 of inner body member 50 opposes upwardly facing surface 36 of first base section 24 which forms the bottom of U-shaped channel 22, and surfaces 36,62 are opposed wire-clamping surfaces to engage and clamp adjacent surfaces of wires 12,14 when connector assembly 10 is crimpingly deformed during application. Wire-clamping surfaces 36,62 press wires 12,14 against wire-proximate surfaces of insert member 70 positioned in U-shaped channel 22. Crimping is easily performed by squeezing bent-back free ends 32 toward each other such as by pliers; outer tabs 28 are rotated about notched bends 30 which define pivot points. After crimping begins, free ends 56 of inner tabs 54 firmly engage bottoms of slots 34; continued rotation of outer tabs 28 toward each other during crimping in turn rotates inner tabs 54 toward each other about grooves 58 which define pivot points, until both outer and inner tabs attain a vertical orientation. During crimping, free ends 56 of inner tabs 54 are trapped in bent-back free ends 32 of outer tabs 28; rotation of inner tabs 54 to vertical causes second base section 52 to move relatively downwardly toward first base section 24, since inner tabs 54 are rotated through a greater angle than are outer tabs 28.

Figure 4:
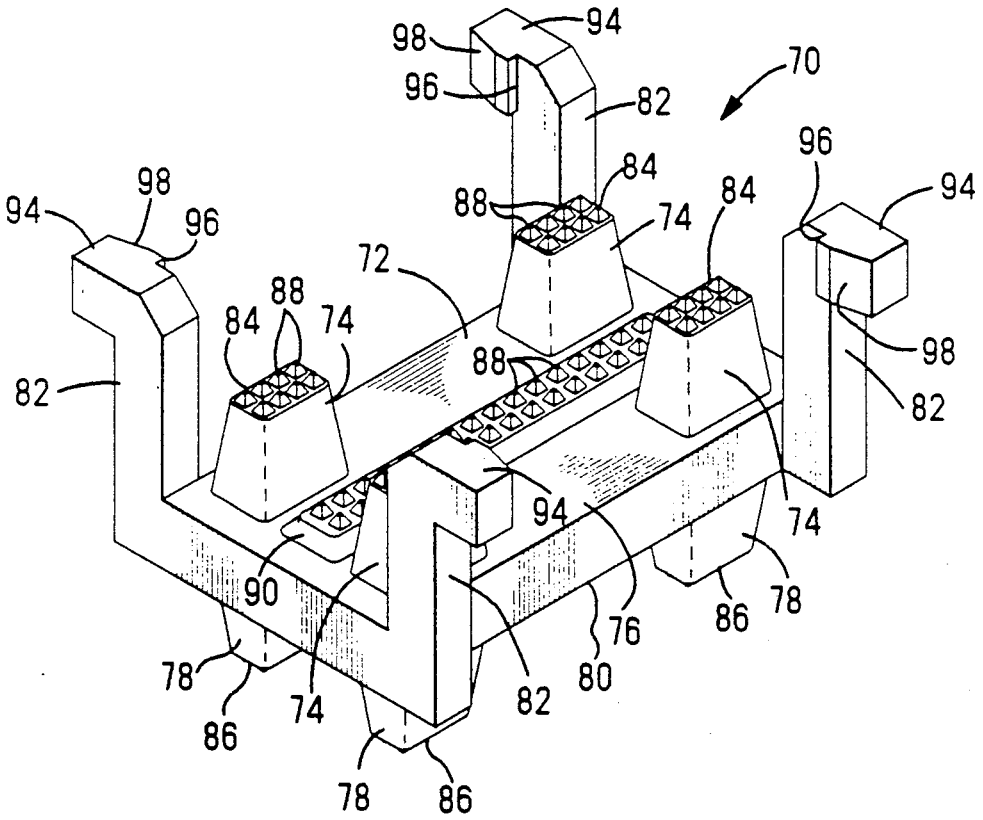
FIG. 4 is an enlarged perspective view of the insert member.

As seen in FIGS. 2 and 4, insert member 70 includes a planar base section 72, four raised platforms 74 extending upwardly from upper surface 76 of base section 72 at the four corners thereof, four raised platforms 78 extending downwardly from lower surface 80 at the four corners thereof, and preferably four legs 82 extending upwardly from lateral edges of base section 72 outwardly of the four corners. Planar base section 72 has a width about as large as the width of U-shaped channel 22 so that lateral edges of said planar base section abut inside surfaces of vertical wall sections 26 of outer body member 20 proximate bends 30 to support vertical wall sections 26 during crimping and facilitate rotation of outer tabs 28 at bends 30. Outer surface portions 84,86 of raised platforms 78,82 are respectively coplanar and face wire-clamping surfaces 36,62 of outer and inner body members 20,50 respectively and include arrays of small penetration spikes 88 associated with a flat wire such as wire 12; wire-proximate portions 90,92 of upper and lower surfaces 76,80 of base section 72 also include an elongate array of small penetration spikes 88 associated with a round wire such as wire 14. Each spike 88 is pyramidal in shape and having a height of about 0.020 inches high at its very small radiused or rounded apex.

Figure 6:
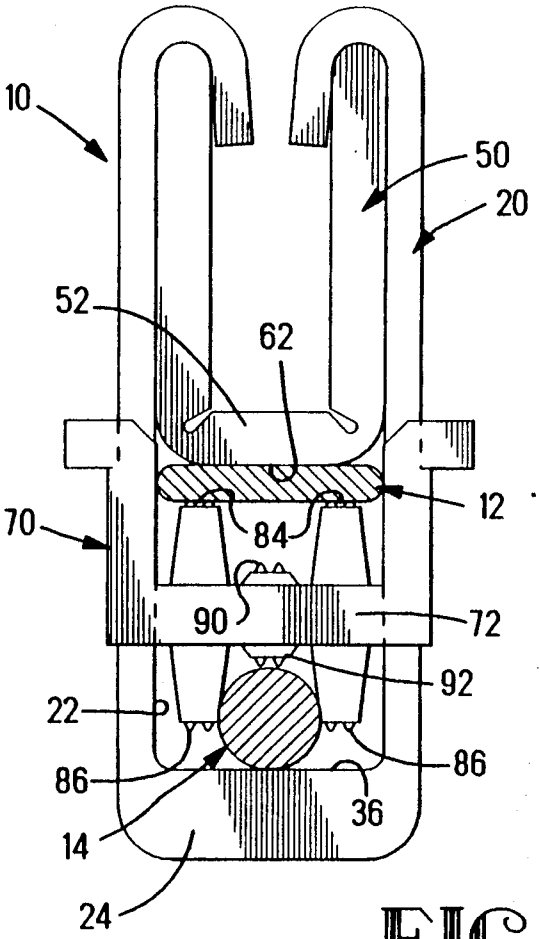

As seen in FIGS. 4 through 8, the arrays of penetration spikes 88 at surface portions 84,86,90,92 are positioned to engage an adjacent surface of a wire whether the wire be flat such as wire 12 or round such as wire 14 in either upper passageway 16 or lower passageway 18 of connector assembly 10. Upon connector assembly 10 being crimped to press wire-clamping surfaces 36,62 of outer and inner body members 20,50 against outwardly facing surfaces of wires 12,14, the plurality of penetration spikes break into and through a layer of corrosion averaging up to about 0.0035 inches thick and dig deeply into uncorroded metal substrates of the wires to establish a plurality of electrical connections for an assured grounding connection of the insert member 70 with each wire 12,14 thereby interconnecting the wires. In FIG. 6 a flat wire 12 is interconnected with a round wire 14 by arrays of spikes 88 of surface portions 84 of upper raised platforms 74 and surface portion 92 of base section 72; in FIG. 7 two round wires 14 are disposed between upper raised platforms 74 and lower raised platforms 78 and interconnected by arrays of spikes 88 of surface portions 90,92 of base section 72; and in FIG. 8 two flat wires 12,12 are interconnected by arrays of spikes 88 of surface portions 84,86 of upper and lower raised platforms 74,78.

As best seen in FIG. 1, legs 82 are spaced far enough apart to coextend along edges 38 of vertical wall sections 26 of outer body member 20 at the ends of U-shaped channel 22 upon assembly. Feet 94 extend outwardly from legs 82 to extend past edges 40 of outer tabs 28, and include latching surfaces 96 adapted to engage and latch behind outer surfaces 42 of outer tabs 28 when outer tabs 28 have been deformed into a vertical orientation. Slightly angled surfaces 98 facilitate outer tabs 28 to slightly deflect legs 82 outwardly during crimping to enable edges 40 of outer tabs 28 to pass beside the enlarged ends of feet 94 during crimping, after which feet 94 will resile to engage the latching surfaces 96 behind outer surfaces 42. When engaged in a latched condition, feet 94 of legs 82 provide a visual indication or assurance that the connector assembly has been fully applied to the wires and that it remains fully applied when examined later, without a need for electrical testing.

Assembly 10 can retain itself in an assembled condition prior to application, with careful fabrication of members 20,50,70 as follows: the width of planar base section 72 of insert member 70 is incrementally larger than the width of U-shaped channel 22 to establish a force fit when inserted into the top thereof; the finally-formed inner body member 50 can then be inserted between outer tabs 28 of outer body member 20 and drop into position between pairs of leg sections 82 of insert member 70. Upon careful manipulation, inner body member 50 and the insert member 70 can be disassembled on-site to be applied to one or two continuous wire lengths.

Insert member 70 is preferably cast from low resistance copper such as Copper Alloy No. C81700 heat treated to a Brinnel hardness of 195 minimum. Each penetration spike can have sides sloped at about 14° from vertical and a height of about 0.020 inches; spikes 88 of each array may be spaced apart with their apices about 0.028 to 0.030 inches from each other. It is preferred that insert member 70 include about thirty-two penetration spikes engageable with each wire: each elongate array 90,92 may have two rows of sixteen spikes, and each of the outer surface portions 84 of the four upper raised platforms 74 and outer surface portions 86 of the four lower raised platforms 78 may have two rows of four spikes. Planar base section 72 may have a thickness of about 0.10 inches; each of the raised platforms 74,76 may be rectangular and have outer surface portions of about 0.114 by 0.063 inches.

Outer body member 20 may be preferably stamped or optionally extruded in its final shape, having a general thickness of about 0.060 inches, from for example Copper. Alloy No. 110 half hard temper, while base section 24 would have the same thickness or may have a thickness of about 0.150 inches and thus be reinforced if desired. The outer tabs preferably are extruded at an angle $\alpha$ of about 30° and bent-back free ends have partially open slots 34 with radiused bottoms at least as wide as the thickness of inner body member 50. Inner body member 50 may be extruded flat, having a thickness of about 0.090 inches, from for example Copper Alloy No. 110, with grooves 58 about 0.045 inches deep formed during extrusion to have sides angled at about 30°; thereafter, inner tabs 54 are controllably bent about grooves 58 to the desired angle $\beta$ which may be 45°; preferably free ends 56 are radiused corresponding to the bottoms of slots 34 of outer tabs 28 of outer body member 20. The outer and inner body members may also be formed of stainless steel needing less thickness. The outer and inner body members may also be made of other materials of similar mechanical properties which need not be good electrical conductors since the inner and outer body members are not relied upon as part of the grounding path interconnecting the wires.

Figure 9:
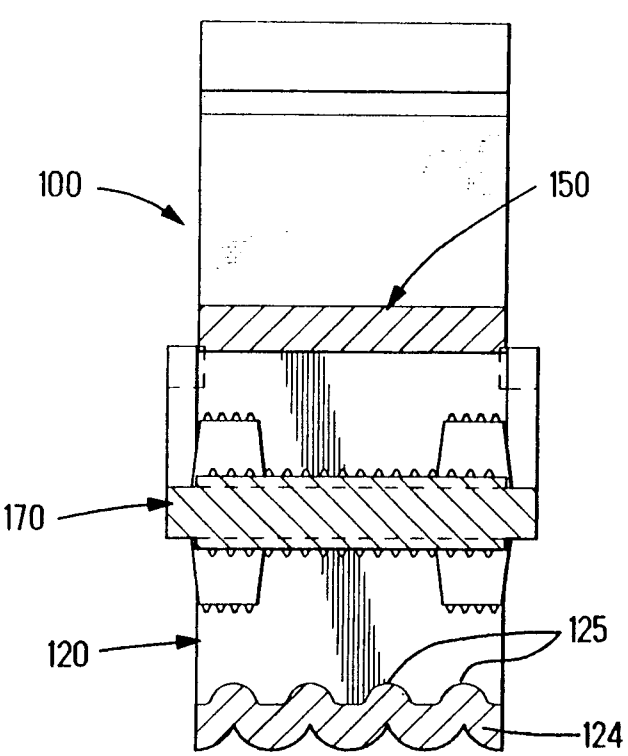
FIG. 9 is a longitudinal section view showing an alternative embodiment of outer body member of the connector of the present invention having a reinforced base section.
Figure 8:
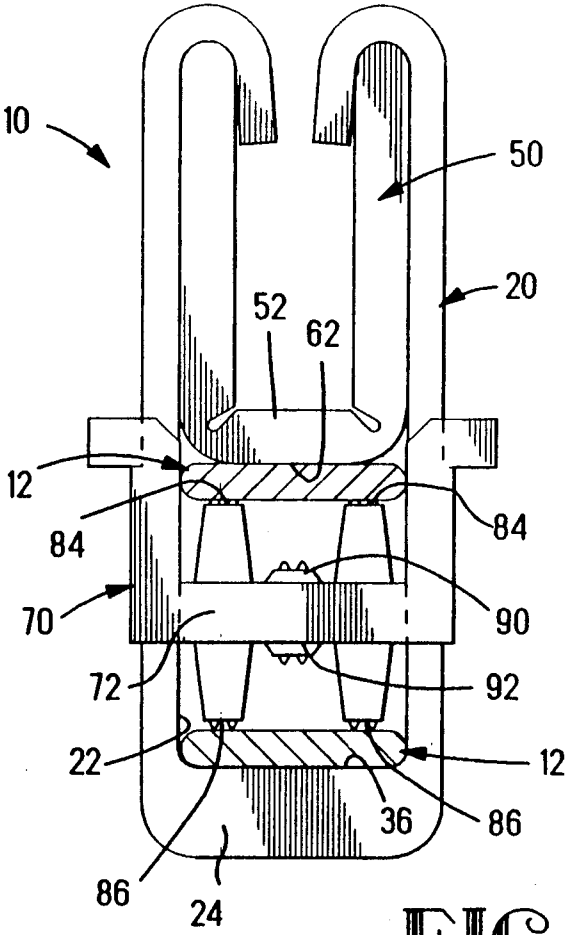

FIG. 9 illustrates another embodiment of connector 100 in longitudinal section, wherein the outer body member 120 has a constant thickness and the reinforcement of base section 124 is attained by stamping base section 124 to have a plurality of transverse strength ribs 125. The inner body member 150 and insert member 170 may be identical to those of connector 10 in FIGS. 1 to 8.

Figure 10:
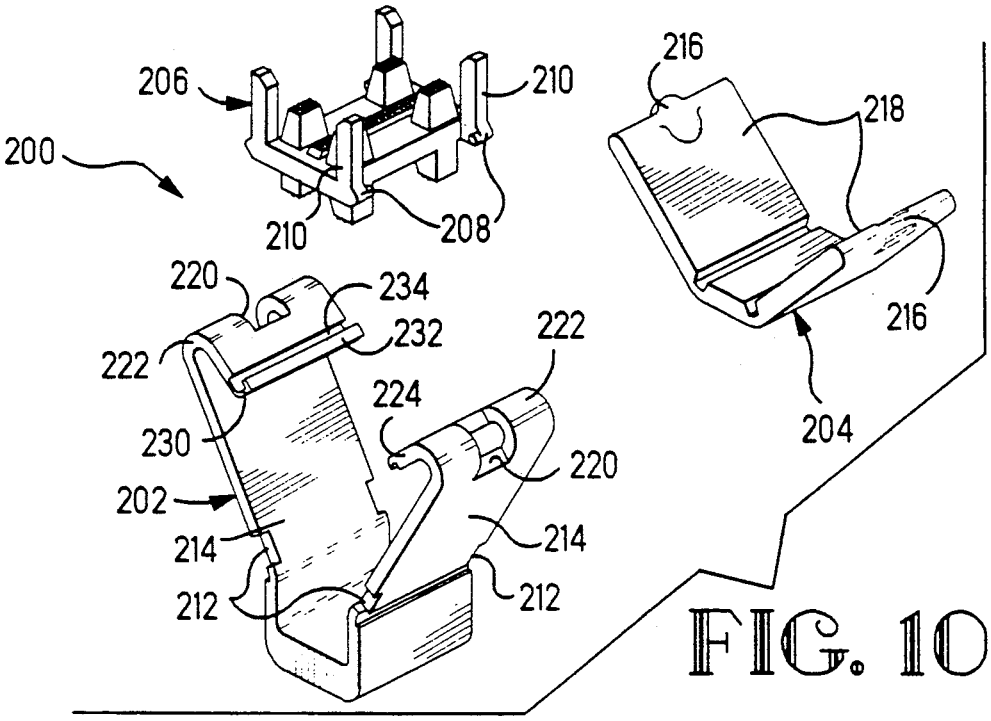
FIGS. 10 to 12 illustrate a second embodiment of connector similar to that of FIGS. 1 to 8 and adapted to lock upon crimping, with FIG. 10 being an exploded isometric view, FIG. 11 being an assembled isometric view prior to crimping, and FIG. 12 being an elevation view after crimping.
Figure 11:
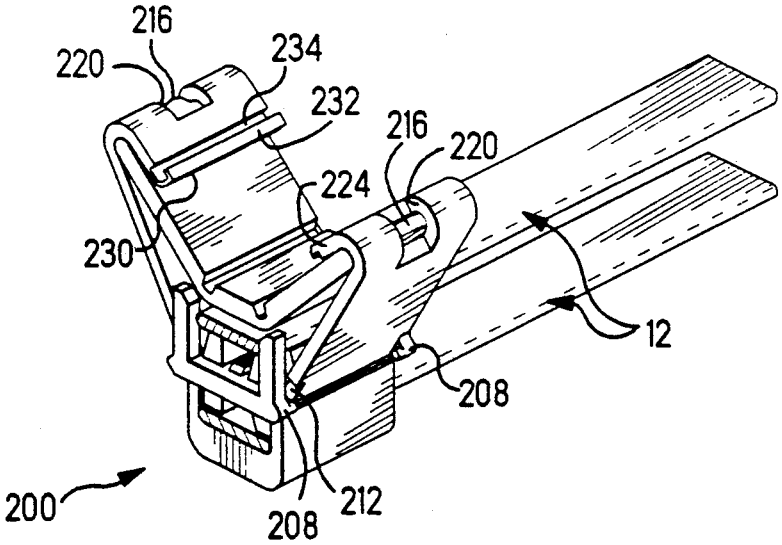
Figure 12:
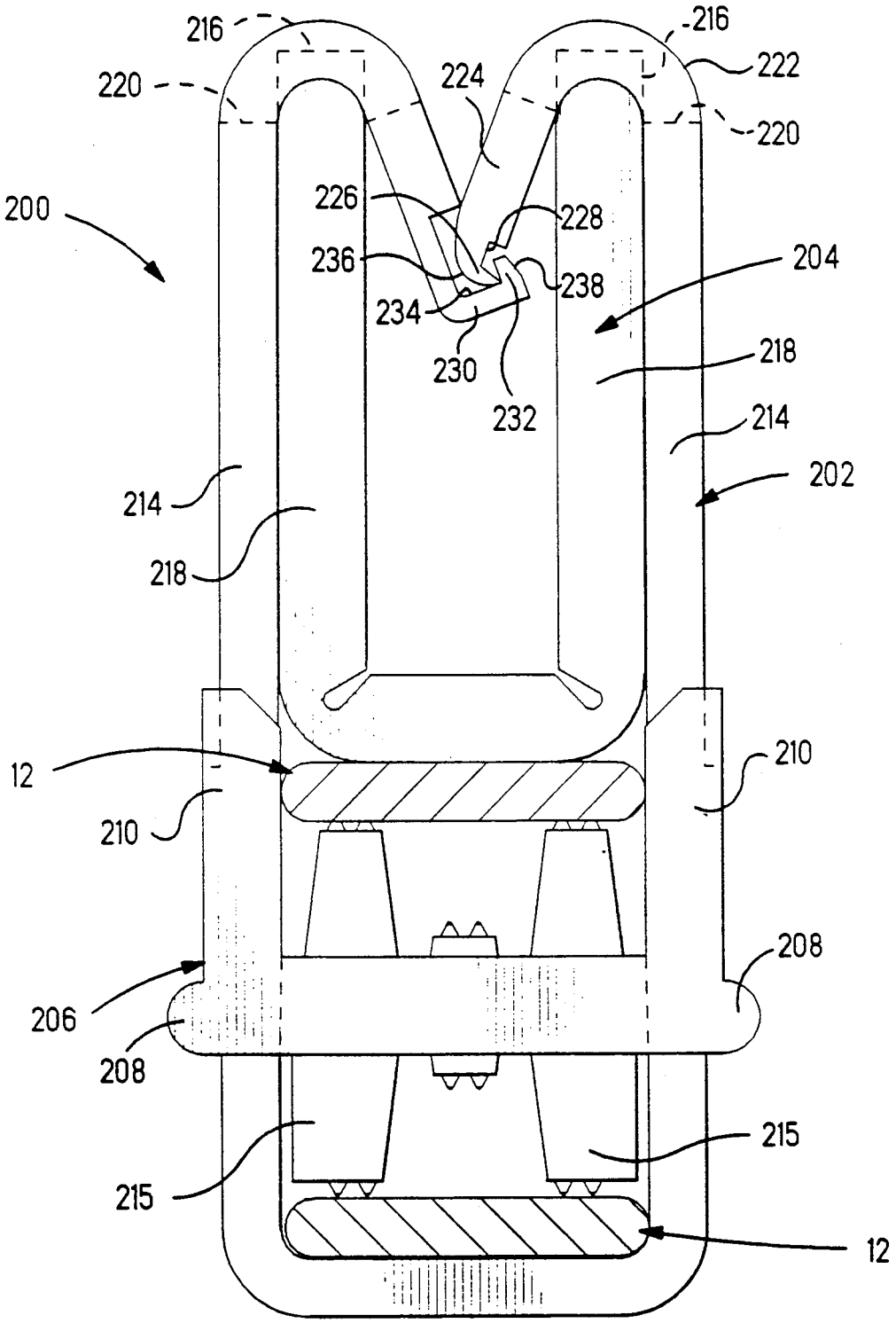

In FIGS. 10 to 12, another embodiment of grounding connector 200 is illustrated with respect to a pair of flat wires or conductors 12, having outer body member 202, inner body member 204 and insert member 206. Insert member 206 includes embossments 208 formed to extend laterally outwardly from bases of respective legs 210 extending upwardly at the four corners thereof, which become disposed within recesses 212 into side edges of tabs 214 near the bases thereof, thus maintaining insert member 206 located within outer body member 202. Inner body member 204 includes locating embossments 216 formed to extend upwardly from free ends of tabs 218, which become disposed within apertures 220 through bends 222 of tabs 214 of outer body member, when inner body member 204 is placed therewithin during initial stages of crimping thus locating inner body member appropriately between tabs 214 during crimping. Lower raised platforms 215 preferably extend laterally outwardly to almost about inside surfaces of tabs 214 which serves to disallow undesirable rotation about a round lower conductor which otherwise could lead to nonsymmetric bending of the outer and inner tabs 214,218.

Also shown in connector 200 is a means for locking the connector together upon full crimping, as seen in FIG. 12. Free ends 224,230 of respective ones of tabs 214 of outer body member 202 extend from bends 222 at angles in order to engage upon full crimping, and are machined to provide formations which interlock upon engagement when tabs 214 are urged into their vertical orientation indicative of full crimping. One free end 224 includes a flange 226 behind which is defined a groove 228, while the other free end 230 is slightly longer and includes an upturned flange 232 behind which is an undercut groove 234. Undercut groove 232 is adapted to receive flange 226 of free end 224 thereinto to lock behind upturned flange 232 of free end 230. Free ends 224,230 are adapted to bearingly engage to deflect apart under spring bias while flange 226 rides over flange 232, with bearing surface 236 of free end 224 and bearing surface 238 of free end 230 being beveled to prevent stubbing and to initiate deflection of the free ends in the appropriate opposite directions, and the deflected free ends 224,230 resile for flanges 226,232 to interlock behind each other in respective grooves 234,228.

Figure 13:
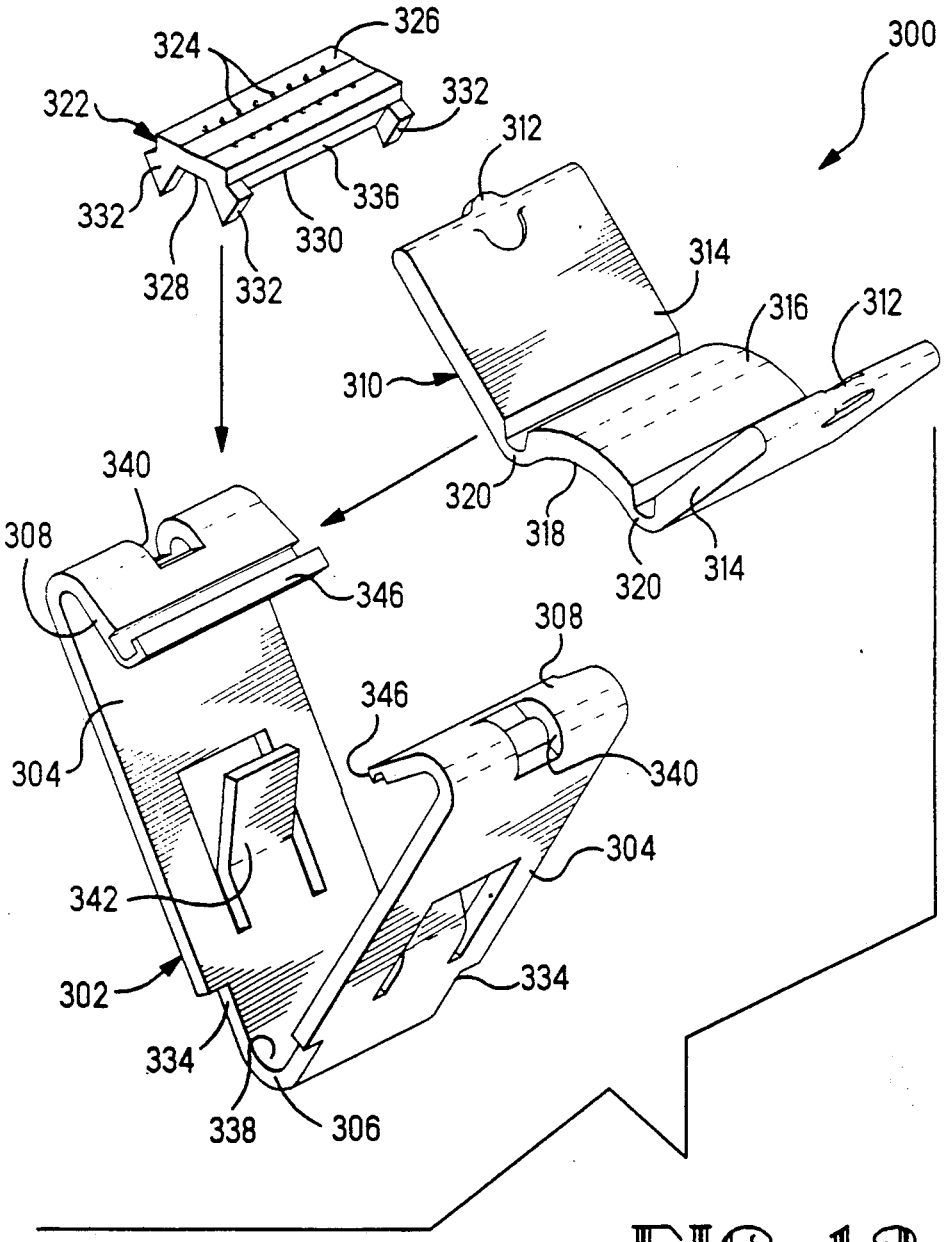
FIGS. 13 to 15 illustrate a third embodiment of connector which is adapted to connect a wire to a large diameter rod or pipe, with FIG. 13 being an exploded isometric view, and FIGS. 14 and 15 being elevation views prior to and after crimping.
Figure 14:
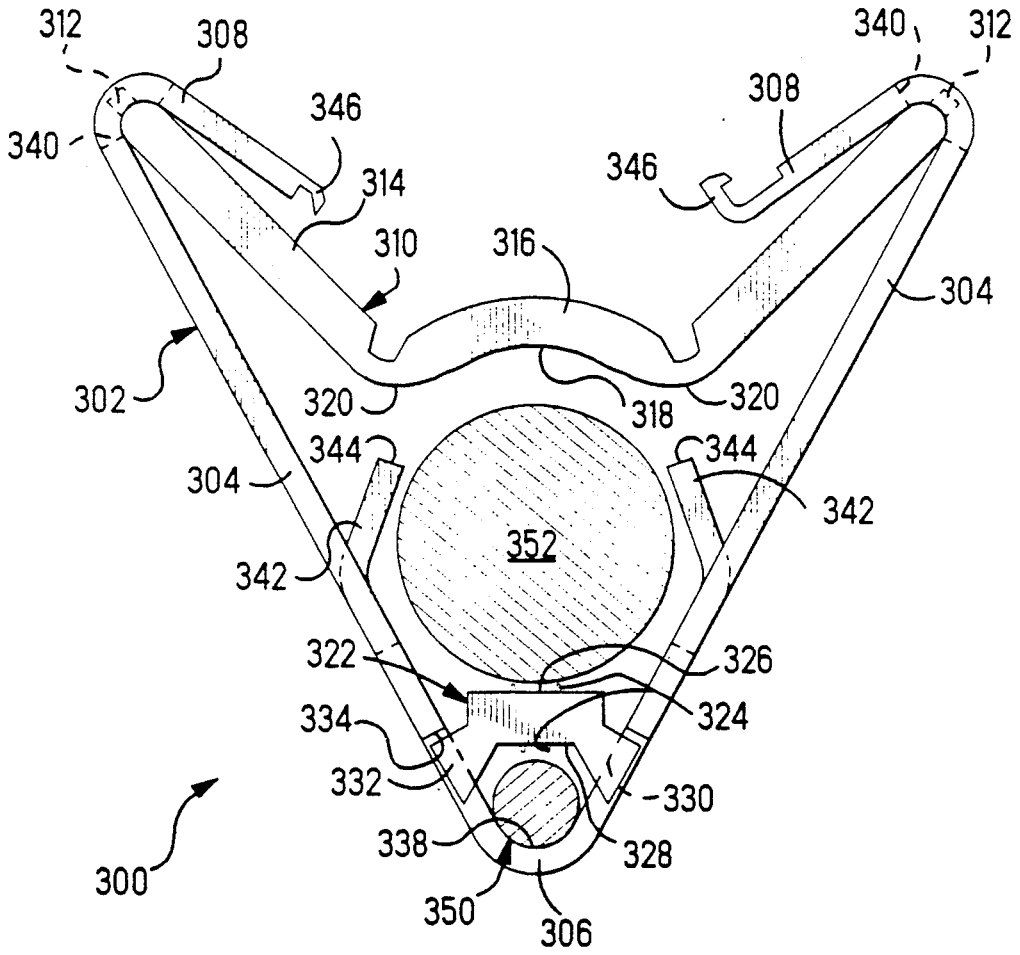
Figure 15:
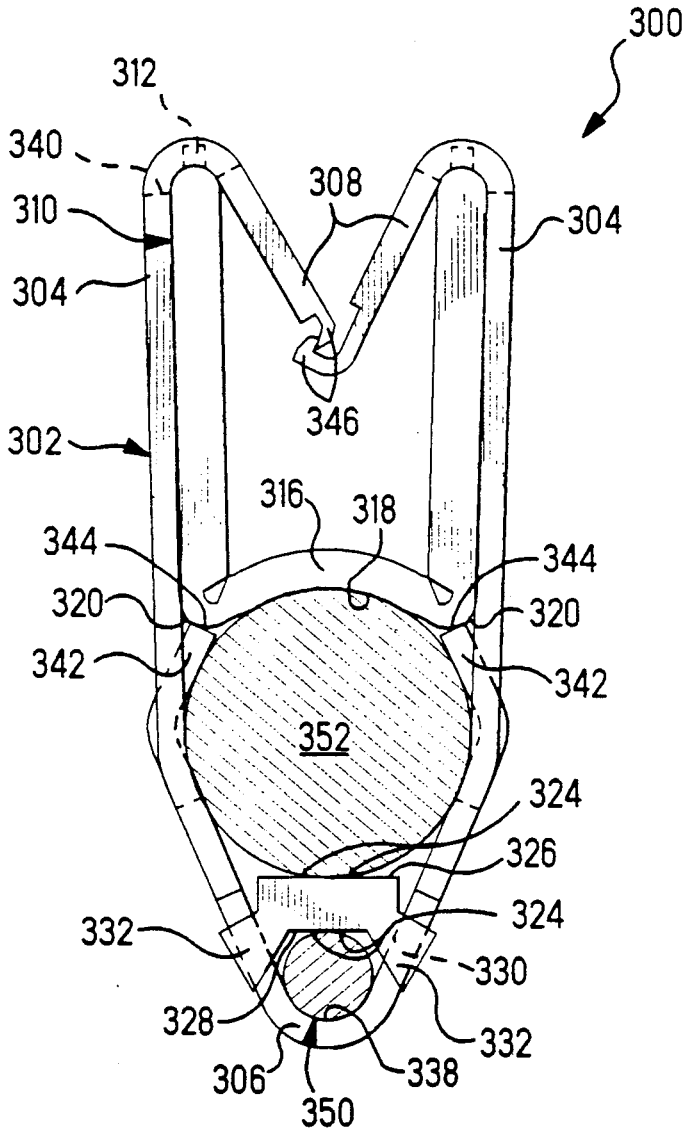

A third embodiment of connector 300 is illustrated in FIGS. 13 to 15, adapted to connect a round wire with a larger diameter rod or pipe. Outer body member 302 is generally V-shaped with tabs 304 extending at an angle upwardly and outwardly from a rounded base section 306 to bent-back free ends 308, which are adapted to interlock upon full crimping similarly to connector 200 in FIGS. 10 to 12. Base section 306 has a radius about equal to the diameter of a standard size round wire with which connector 300 is to be used. Inner body member 310 is similar to member 204 of FIG. 10, preferably including locating bosses 312 at free ends of tabs 314; base section 316 is formed to arc upwardly about a radius equal to that of the larger diameter rod or pipe with which the connector is to be used, to define a concave downwardly facing rod-clamping surface 318 between bendable joints 320 of tabs 314 to base section 318. Insert member 322 is formed to a substantially different shape from that of insert member 70 of FIG. 2 and insert member 206 of FIG. 10, but includes axially aligned rows of corrosion-penetrating spikes 324 on upper rod-engaging surface 326 and lower wire-engaging surface 328. Rod-engaging surface 326 is essentially flat with two rows of spikes 324; wire-engaging surface 328 includes a pair of spike rows along the center thereof, and a pair of pointed ridges 330 depend from both lateral sides. At ends of ridges 330 and downwardly and laterally outwardly therefrom extend projections 332 which are received within corresponding recesses 334 of outer body member 302 along end edges of V-shaped base section 306, for locating insert member 322 therewithin and therealong. Outwardly facing surfaces 336 of ridges 330 are angled to coincide with inside surfaces of V-shaped base section 304 upon full crimping, as seen in FIG. 15, while inwardly facing surfaces are shaped to be free of engagement with a wire disposed therebetween.

In FIG. 14, connector 300 has been assembled about a portion of a small diameter wire 350 disposed along the inner surface 338 of V-shaped outer body member 302 below insert member 322, and a portion of a large diameter grounding rod 352 disposed atop rod-engaging surface 326 of insert member 322 and between tabs 304 of outer body member 302. Inner body member 310 has been placed above grounding rod 352 between tabs 304 similarly to the positioning of inner body member 204 in FIG. 11, with locating bosses 312 disposed in apertures 340. Lances 342 have been struck from middle portions of tabs 304 of outer body member 302 to extend at an angle inwardly and upwardly to free ends 344, with free ends 344 formed to oppose bottom surfaces of bendable joints 320 of inner body member 310; lances 342 also are proximate portions of grounding rod 352.

In FIG. 15, tabs 304 have been urged toward each other by pliers until vertical, bending generally about grounding rod 352, urging inner body member 310 downwardly for concave lower surface 318 of base section 316 to clamp against the top surface of grounding rod 352 and in turn urge rod 352 against corrosion-penetrating spikes 324 of insert member 322, which in turn is clamped against wire 350 to press it tightly against inner surface 338 of V-shaped base section 306 of outer body member 302. Free ends 308 of tabs 304 are interlocked by means of flanges 346. Arrays of corrosion-penetrating spikes 324 on rod-engaging surface 326 and wire-engaging surface 328 establish electrical connections with conductive material of grounding rod 352 and with wire 352, respectively, thus groundingly connecting them.

Other variations may be devised which are within the spirit of the invention and the scope of the claims. For example, other shapes of penetrating formations may be included which break through the corrosion of the wires, and shapes of outer and/or inner extensions other than tab shapes, could easily be devised. Also, especially in view of the grounding rod embodiment of FIGS. 13 to 15, connectors may be formed which are adapted to engage a pair of flat wires only, or a pair of round wires only, simply by simplifying the structure of the insert member. It is also within the spirit of the invention to utilize other structures which when crimped together, clamp a pair of wire-clamping surfaces of the connector against a pair of wires and cause arrays of penetration spikes of a common insert member or of the wire-clamping surfaces themselves to break through the wire corrosion and interconnect the wires to establish an assured grounding path.

What is claimed is:

1. An electrical grounding connector for interconnecting lengths of a pair of conductive members, comprising:

an assembly of at least an outer body member including a first base section, and an inner body member including a second base section and being disposed within said outer body member, said first base section defining a first conductor-clamping surface and said second base section opposed therefrom and defining a second conductor-clamping surface, said first and second base sections defining a conductor-receiving region therebetween;

said assembly including corrosion-penetrating means defined along at least two opposed surface portions adjoining said conductor-receiving region and engageable with surfaces of lengths of each of a pair of conductors disposed within said conductor-receiving region, and said assembly defining a conductive path between said corrosion-penetrating means;

said outer body member having a pair of first extensions extending from at least proximate opposed lateral edges of said first base section, and said inner body member having a pair of second extensions extending from opposed lateral edges of said second base section, said first extensions diverging at a selected first angle from first joints at said conductor-receiving region, and said second extensions extending along inside surfaces of said first extensions and diverging at a slightly greater selected angle from second joints with said second base section at said conductor-receiving region;

said first extensions including engagement means proximate free ends thereof firmly engageable during crimping with cooperating engagement means of said second extensions proximate free ends thereof, said cooperating engagement engagement means closer to said second joints than the distance of said means to said first joints, whereby when said first extensions are deformed by being rotated toward each other about said first joints, said second extensions therebetween are correspondingly rotated by said first extensions toward each other about said second joints and said cooperating engagement means are engaged by said engagement means and cause said second extensions to urge said second base section of said inner body member toward said first base section pressing said conductor-clamping surfaces against conductors disposed in said conductor-receiving region and urging said corrosion-penetrating means against said conductors and through corrosion on surfaces thereof to establish an electrical interconnection sufficient to define a grounding connection therebetween.

2. An electrical grounding connector as set forth in claim 1 further including indicator means for indicating that the assembly has attained a fully crimped configuration.

3. An electrical grounding connector as set forth in claim 2 wherein said indicator means is a visual indication which after crimping is adapted to continuously indicate a fully crimped configuration thereafter.

4. An electrical grounding connector as set forth in claim 1, wherein said corrosion-penetrating means comprise arrays of closely-spaced small spikes.

5. An electrical grounding connector as set forth in claim 4 wherein said arrays of spikes are disposed on conductor-proximate faces of an insert member disposed in said conductor-receiving region between said first and second conductor-clamping surfaces, said arrays of spikes positioned to engage surfaces of respective conductors to be disposed between said conductor-proximate faces and said first and second conductor-clamping surfaces.

6. An electrical grounding connector as set forth in claim 1 wherein said first extensions have tab shapes, and said engagement means comprises free ends thereof bent back along said inside surfaces thereof to define slots.

7. An electrical grounding connector as set forth in claim 6 wherein said first joints are characterized by notches formed into outer surfaces thereof to facilitate bending of said tab-shaped first extensions thereat.

8. An electrical grounding connector as set forth in claim 6 wherein said second extensions have tab shapes, and said cooperating engagement means comprises free ends thereof disposed within said bent-back free ends of said first extensions engageable during crimping with bottoms of said slots.

9. An electrical grounding connector as set forth in claim 8 wherein said second joints are characterized by grooves along said lateral edges of said second base section into a conductor-remote surface thereof opposed from said conductor-clamping surface to facilitate bending of said tab-shaped second extensions thereat.

10. An electrical grounding connector as set forth in claim 8, wherein said free ends of said second extensions include locating bosses extending slightly beyond said free ends and centrally therealong, and said slots of said bent-back free ends of said first extensions include cooperating apertures therethrough into which said locating bosses extend upon full crimping.

11. An electrical grounding connector as set forth in claim 1 wherein said first extensions have tab shapes including bent-back portions extending along and at an angle with respect to inside surfaces of said tab shapes to end edges adapted to engage upon full crimping, and said end edges including locking means to mechanically secure said tab shapes together and assuredly retain said assembly in its fully crimped configuration.

12. An electrical grounding connector as set forth in claim 11 wherein said locking means comprises flanges adapted to interlock behind each other in respective associated grooves, and bearing surfaces of said end edges are beveled in a manner to initiate deflection of said bent-back portions for said flanges to ride over each other until entering said associated grooves whereupon said bent-back portions resile and said flanges interlock.

13. An electrical grounding connector as set forth in claim 1 wherein said first base section is reinforced.

14. An electrical grounding connector as set forth in claim 13 wherein said first base section is thicker than the general thickness of said outer body member.

15. An electrical grounding connector as set forth in claim 13 wherein said first base section has transverse strength ribs formed thereinto.

16. An electrical grounding connector as set forth in claim 1, wherein said outer body member includes vertical wall sections extending from said first lateral edges of said base section to said first joints thus defining a U-shaped channel, and said assembly further includes an insert member disposed within said U-shaped channel between said first and second conductor-clamping surfaces and includes a base section having first and second conductor-proximate faces opposing said first and second conductor-clamping surfaces forming respective conductor-receiving passageways, and said corrosion-penetrating means are defined on portions of said first and second conductor-proximate surfaces of said insert member, engageable with said surfaces of said lengths of conductors to be disposed within respective said conductor-receiving passageways upon said conductor-clamping surfaces urging said conductors against said surface portions of said insert member.

17. An electrical grounding connector as set forth in claim 16, wherein said corrosion-penetrating means comprise arrays of closely-spaced small spikes.

18. An electrical grounding connector as set forth in claim 17 wherein said base section of said insert member is planar and said insert member includes an elongate array of said spikes along a median of each conductor-proximate face of said planar base section each engageable with and along a surface of a respective round conductor to be disposed along each conductor-proximate face of said planar base section, whereby said assembly is suitable for groundingly interconnecting a pair of round conductors.

19. An electrical grounding connector as set forth in claim 18 wherein said insert member includes along each said conductor-proximate face at least two raised platforms extending from proximate lateral edges of said planar base section on each side of said elongate spike array to outer surface portions including respective arrays of spikes each engageable with and along surfaces adjacent lateral edges of a respective flat conductor disposed along each conductor-proximate face adjacent said outer surface portions of said raised platforms, whereby said assembly is suitable for groundingly interconnecting a pair of conductors irrespective of either conductor being flat or round.

20. An electrical grounding connector as set forth in claim 19 wherein said insert member includes four said raised platforms along each said conductor-proximate face in pairs spaced apart along each said lateral edge of said planar base section.

21. An electrical grounding connector as set forth in claim 20 wherein said four raised platforms along the one of said conductor-proximate faces facing said first base section of said outer body member include laterally outwardly facing side surfaces shaped and dimensioned to be adjacent to inner surfaces of said first extensions, stabilizing said insert member therebetween during crimping to a round lower conductor.

22. An electrical grounding connector as set forth in claim 16 wherein said insert member further includes leg sections coextending from corners thereof along outer edges of said vertical wall sections of said outer body member to feet extending outwardly along edges of said outer extensions, and said feet including latching means adapted to extend along outwardly facing surfaces of said outer extensions after said outer extensions have been deformed to their fully crimped configuration, whereby the latching of said latching means along said outwardly facing surfaces of said outer extensions defines a visual indication of the assembly attaining a fully crimped configuration.

23. An electrical grounding connector as set forth in claim 22 wherein said feet include extension-facing surfaces engageable with said edges of said outer extensions during rotation thereof during crimping, and said extension-facing surfaces are angled to facilitate deflection of said leg sections away from said outer extension edges when engaged thereby during crimping, whereafter said leg sections resile to attain latching of said latching means along said outwardly facing surfaces of said outer extensions.

24. An electrical grounding connector as set forth in claim 16 wherein said planar base section of said insert member has a width about as large as the width of said U-shaped channel so that lateral edges of said planar base section abut inside surfaces of said vertical wall sections of said outer body member proximate said first joints to support said vertical wall sections during crimping and facilitate rotation of said outer extensions at said first joints.

25. An electrical grounding connector as set forth in claim 1 wherein the lengths of a pair of conductors are a length of wire and a length of ground rod and wherein said first base section is rounded and said first extensions extend divergingly therefrom to define a V-shaped channel, said rounded base section having an inner radius about equal to the radius of a respective said wire to be grounded, and said second base section is arcuate upwardly to define a convex clamping surface having a radius about equal to the radius of a respective said ground rod to which said wire is to be grounded.

26. An electrical grounding connector as set forth in claim 25 wherein said outer body member includes lances formed at bases of said first extensions to extend upwardly and inwardly, said lances being associated with and opposed from bottom surfaces of said second joints for free ends of said lances to be engageable therewith during crimping for support to assure uniform bending thereof.

27. An electrical grounding connector as set forth in claim 25 wherein said assembly further includes an insert member disposed within said V-shaped channel between said first and second conductor-clamping surfaces and includes a base section having first and second conductor-proximate faces opposing said first and second conductor-clamping surfaces forming respective conductor-receiving passageways, and said corrosion-penetrating means are defined on portions of said first and second conductor-proximate faces of said insert member, engageable with said surfaces of said lengths of said grounding rod and wire to be disposed within respective conductor-receiving passageways upon said conductor-clamping surfaces urging said grounding rod and wire against said surface portions of said insert member.

28. An electrical grounding connector as set forth in claim 27 wherein said corrosion-penetrating means comprise arrays of closely-spaced small spikes, and said base section of said insert member is planar and said insert member includes an elongate array of said spikes along a median of each conductor-proximate face of said planar base section each engageable with and along a surface of a respective grounding rod and wire to be disposed along respective ones of said conductor-proximate faces of said planar base section, whereby said assembly is suitable for groundingly interconnecting a wire to a grounding rod of larger diameter.

29. An electrical grounding connector as set forth in claim 27 wherein said insert member includes ridges depending from lateral sides thereof proximate inside surfaces of said first extensions and engageable therewith upon full crimping, said ridges being shaped to support and position said planar base section in a manner not interfering with rotation of said first extensions during crimping and not engaging said wire along said V-shaped channel, and said insert member further includes projections coextending from ends of said ridges received into corresponding recesses along outer edges of said first extensions of said outer body member for retention of said insert member in position within said outer body member during crimping.

* * * * *

UNITED STATES PATENT AND TRADEMARK OFFICE

CERTIFICATE OF CORRECTION

PATENT NO. : 5,151,560

DATED : 09/29/92

INVENTOR(S) : Earl R. Kreinberg et al.

It is certified that error appears in the above-identified patent and that said Letters Patent is hereby corrected as shown below:

In Claim 1, Column 10, Line 7 - delete "engagement" (second occurrence)

In Claim 1, Column 10, Line 8 - after "means" insert --being--.

In Claim 1, Column 10, Line 9 - before "means" insert --engagement--.

Signed and Sealed this

Twenty-first Day of September, 1993

Bruce Lehman

*Attest:*

BRUCE LEHMAN

*Attesting Officer*

*Commissioner of Patents and Trademarks*